US010814236B1

(12) United States Patent
Dagley

(10) Patent No.: US 10,814,236 B1
(45) Date of Patent: Oct. 27, 2020

(54) COASTER TRANSPORTATION SYSTEM

(71) Applicant: Universal City Studios LLC, Universal City, CA (US)

(72) Inventor: James Francis Dagley, Windermere, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 16/414,605

(22) Filed: May 16, 2019

Related U.S. Application Data

(60) Provisional application No. 62/840,168, filed on Apr. 29, 2019.

(51) Int. Cl.
*A63G 31/02* (2006.01)
*A63G 7/00* (2006.01)

(52) U.S. Cl.
CPC ..... *A63G 31/02* (2013.01); *A63G 7/00* (2013.01)

(58) Field of Classification Search
CPC ..... A63G 31/02; A63G 7/00; A63G 31/04; A63G 1/48; A63G 1/12; B61B 12/002
USPC ..... 472/137, 43, 44, 50
See application file for complete search history.

(56) References Cited

U.S. PATENT DOCUMENTS 5,893,802 A 4/1999 Bohme
6,210,284 B1 4/2001 Ochi
6,308,818 B1 10/2001 Bonora et al.
6,341,564 B1 * 1/2002 Ochi ..... A63G 7/00 104/48
6,755,749 B2 6/2004 Stengel
7,371,182 B2 5/2008 Henry et al.
8,057,317 B2 11/2011 Roodenburg et al.
9,486,135 B1 11/2016 Fram
10,589,762 B2 3/2020 Rupp et al.
2007/0074638 A1 * 4/2007 Blum ..... A63G 7/00 104/53
2009/0269175 A1 * 10/2009 Rose ..... A63G 7/00 414/373
2013/0324271 A1 12/2013 Stoker
2016/0023121 A1 * 1/2016 McVeen ..... A63G 31/16 104/84
2017/0225084 A1 8/2017 Snyder et al.
2019/0161099 A1 * 5/2019 Burger ..... A63G 7/00

FOREIGN PATENT DOCUMENTS

NL 1009494 1/2000

OTHER PUBLICATIONS

Jagolinzer, Scott, "Tackless Multi-Dimensional Ride Vehicle," May 13, 2015, https://contest.techbriefs.com/2015/entries/automotive-transportation/5347.
PCT/US2020/030187 International Search Report and Written Opinion Jul. 10, 2020.

* cited by examiner

*Primary Examiner* — Michael D Dennis
(74) *Attorney, Agent, or Firm* — Fletcher Yoder, P.C.

(57) ABSTRACT

A ride system includes a vehicle configured to travel along a first ride path. The ride system also includes a coaster that travels along a second ride path that overlaps with the first ride path at an overlapping portion of the ride system. The vehicle disengages from a first portion of the first ride path and engages with the coaster when the coaster is positioned at the overlapping portion, such that the coaster transports the vehicle along the second ride path to a second portion of the first ride path after engaging with the vehicle.

20 Claims, 10 Drawing Sheets

COASTER TRANSPORTATION SYSTEM

CROSS REFERENCE TO RELATED APPLICATIONS

This application claims priority to and the benefit of U.S. Provisional Patent Application No. 62/840,168, entitled "Coaster Transportation System," filed Apr. 29, 2019, which is hereby incorporated by reference in its entirety for all purposes.

BACKGROUND

Generally, amusement park-style rides include ride vehicles that carry passengers along a ride path, for example, defined by a track. Over the course of the ride, the ride path may include a number of features, including tunnels, turns, ascents, descents, loops, and so forth. The direction of travel of the ride vehicle may be defined by tracks of the ride path, as the ride vehicle may be in constant contact with the tracks. The ride experience associated with such amusement park-style rides may lack surprise to repeated passengers because repeated passengers may be familiar with the ride path and its features. For example, the ride vehicle may travel along the same single loop during every run. As such, there is a need to improve the excitement and reduce the predictability associated with amusement park-style ride systems employing a single track to direct motion of the ride vehicle.

Additionally, servicing features on a portion of the tracks of these amusement park-style rides having a single track (e.g., closed-loop track) may require that the entire amusement park-style ride shut down for maintenance, resulting in loss of revenue, productivity, and false expectations for passengers looking forward to riding such an amusement park-style ride. Accordingly, it may be desirable to improve features of a single track amusement park-style ride to increase the efficiency by which maintenance of a portion of the track may be performed, while improving the excitement associated with the amusement park-style ride, the implementation of which may be difficult to coordinate in practice.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In an embodiment, a ride system includes a vehicle configured to travel along a first ride path. The ride system also includes a coaster that travels along a second ride path that overlaps with the first ride path at an overlapping portion of the ride system. The vehicle disengages from a first portion of the first ride path and engages with the coaster when the coaster is positioned at the overlapping portion and engages with the coaster, such that the coaster transports the vehicle along the second ride path to a second portion of the first ride path after engaging with the vehicle.

In an embodiment, method for controlling multi-dimensional motion of a vehicle includes instructing, via a controller, the vehicle traveling along a first ride path defined by a first track to stop the vehicle at a first position along the first ride path. The method also includes instructing, via the controller, a coaster traveling along a second ride path defined by a second track to stop at a second position along the second ride path, such that the first position and the second position overlap with one another. Furthermore, the method includes actuating, via the controller, one or more securing mechanisms to release the vehicle from the first track at the first position and to secure the vehicle to the coaster. The method also includes instructing, via the controller, the coaster to travel along the second ride path defined by the second track to a third position along the second ride path and to stop at the third position, such that the third position overlaps with the first ride path.

In an embodiment, a ride system includes a first ride path defined by a first track that guide a ride vehicle along the first ride path and includes a second ride path defined by a second track that guides a coaster along the second ride path. The first ride path and the second ride path overlap with one another at a plurality of overlapping portions. The ride system also includes a controller that includes a processor and a memory device having instructions stored thereon that when executed by the processor cause the processor to perform operations. The operations include outputting a first signal to decelerate and stop the ride vehicle at a first position along the first ride path, such that the first position is at a first overlapping portion of the plurality of overlapping portions. The operations further include outputting a second signal to decelerate and stop the coaster at a second position along the second ride path, such that the second position is at the first overlapping portion of the plurality of overlapping portions. The operations include outputting a third signal to actuate one or more securing mechanisms to release the ride vehicle from the first track at the first overlapping portion and to secure the ride vehicle to the coaster. The operations include outputting a fourth signal to actuate the coaster to cause the coaster to travel along the second ride path via the second track to a second overlapping portion of the plurality of overlapping portions.

DRAWINGS

These and other features, aspects, and advantages of the present disclosure will become better understood when the following detailed description is read with reference to the accompanying drawings in which like characters represent like parts throughout the drawings, wherein.

Figure 1:
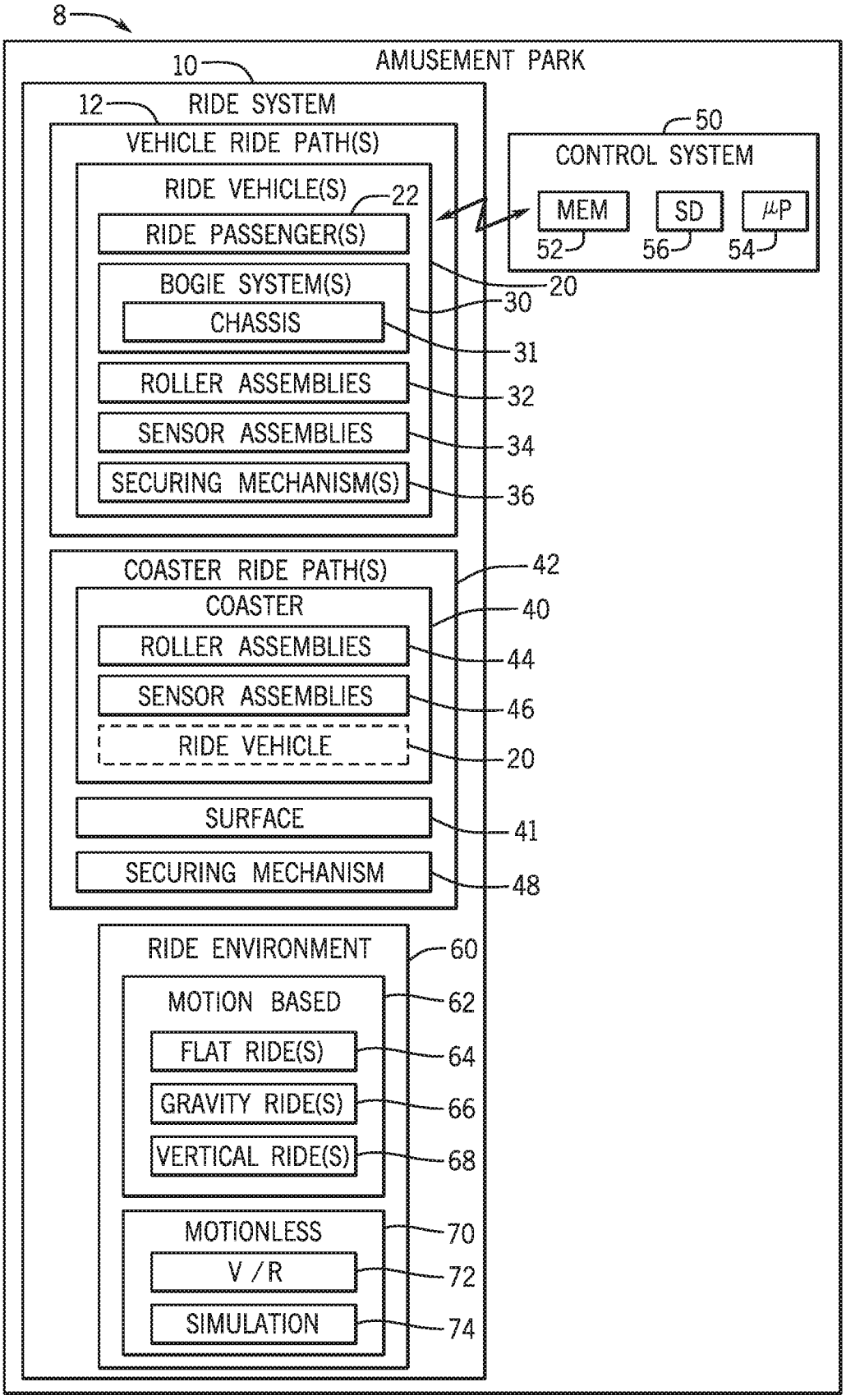
FIG. 1 is a block diagram of an embodiment of various components of an amusement park in which a ride vehicle and coaster may operate, in accordance with aspects of the present disclosure.
Figure 2:
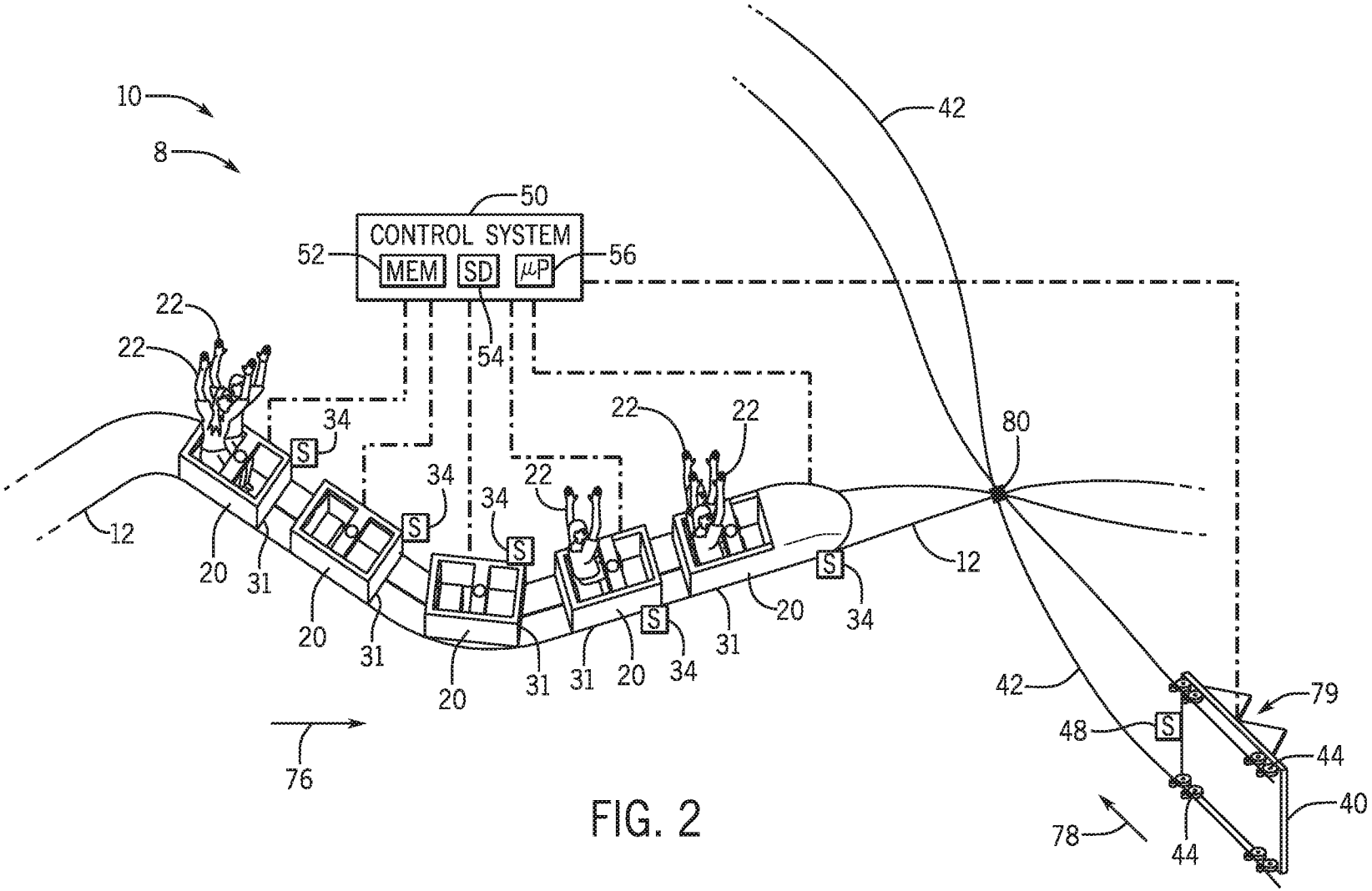
FIG. 2 is a schematic of an embodiment a ride system on which the ride vehicle of FIG. 1 and the coaster of FIG. 1 may operate, in accordance with aspects of the present disclosure.
Figure 9:
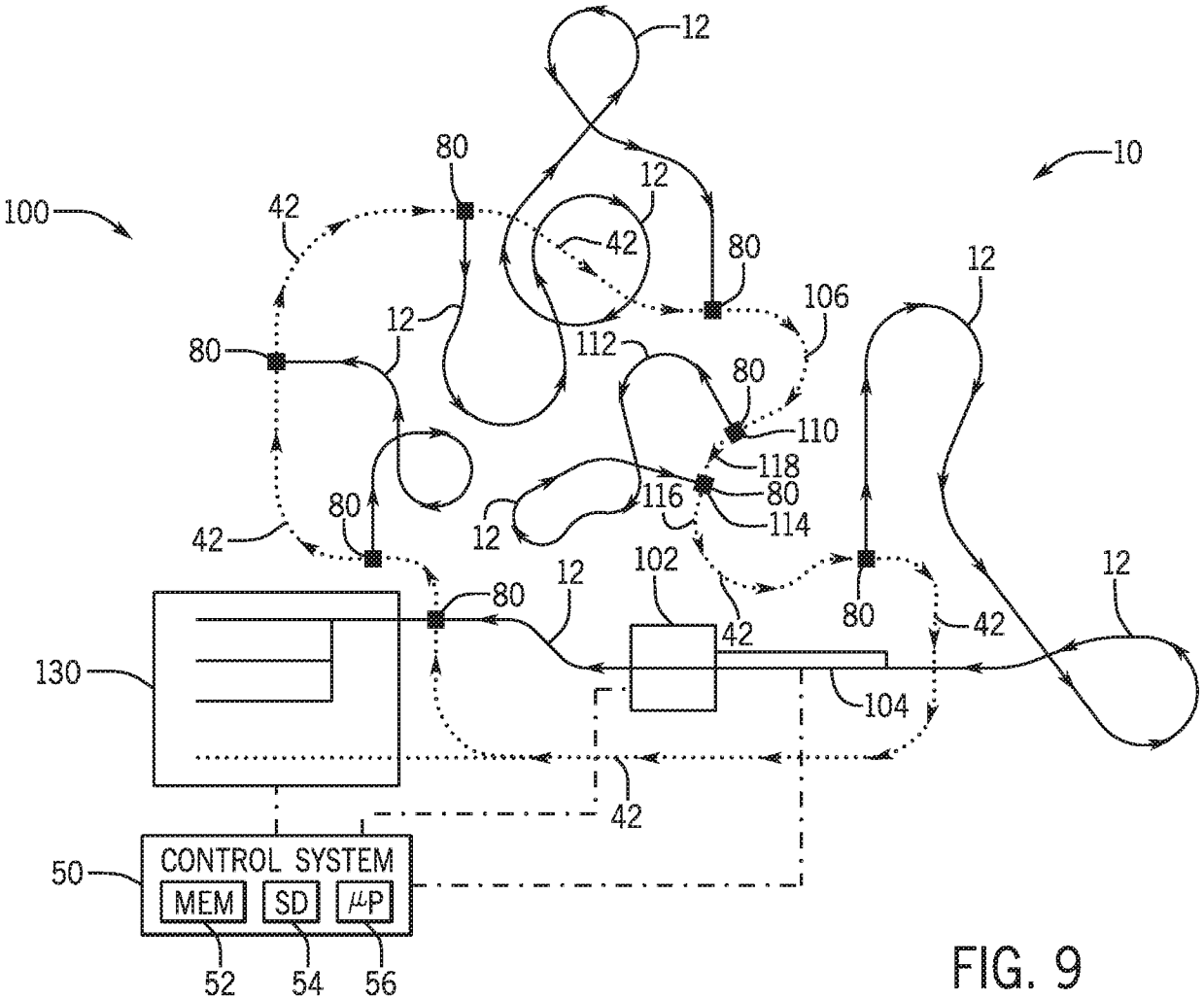
Figure 10:
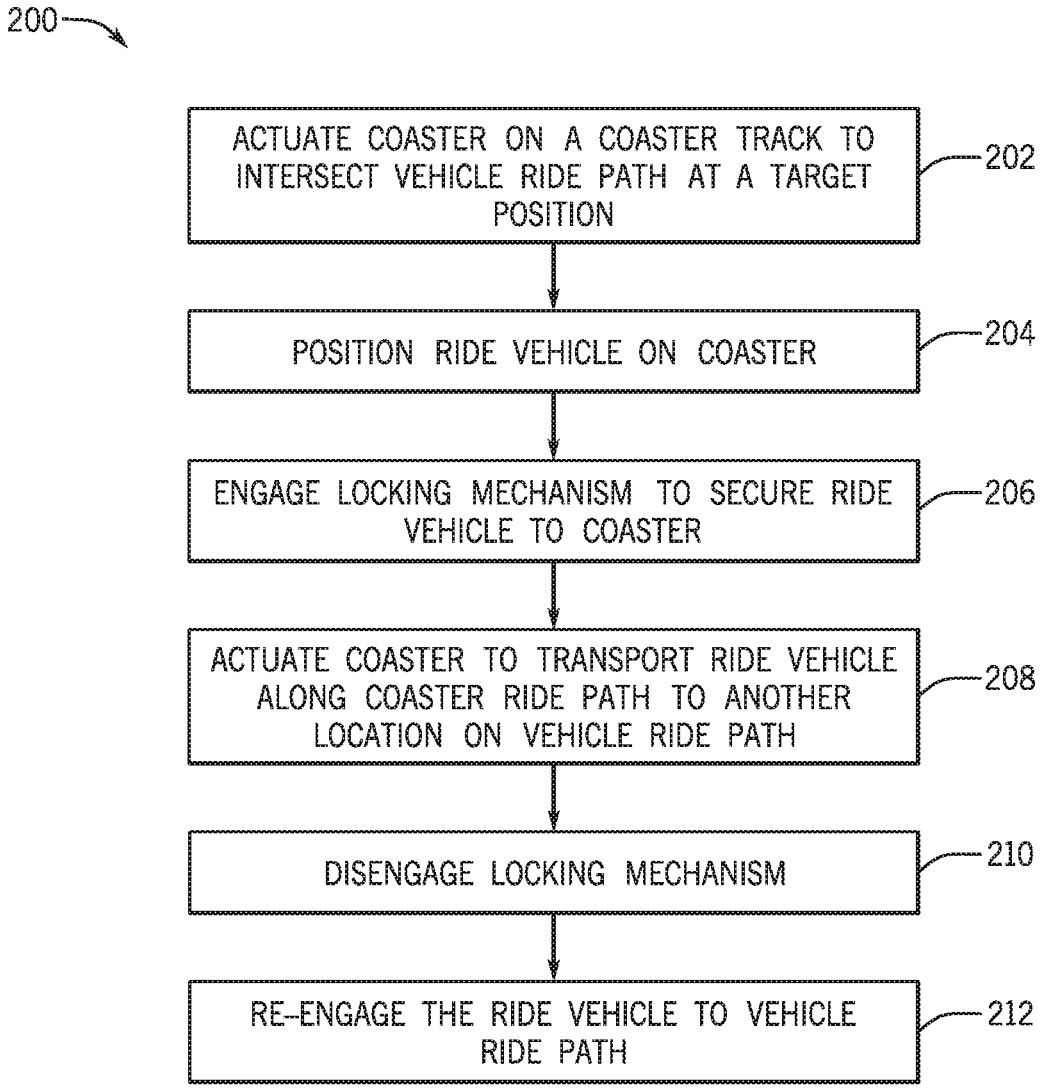

FIG. 9 is a graphical representation of an embodiment of the ride system of FIG. 2, including one or more coaster ride paths and one or more vehicle ride paths, in accordance with aspects of the present disclosure; and FIG. 10 is a flow diagram of an embodiment of a method for transporting the ride vehicle of FIG. 1 from one portion of a vehicle ride path to another portion of the vehicle ride path, in accordance with aspects of the present disclosure.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment," "an exemplary embodiment," or "an embodiment" of the present disclosure are not intended to be interpreted as excluding the existence of additional embodiments that also incorporate the recited features.

While the following discussion is generally provided in the context of amusement park-style rides, it should be understood that the embodiments disclosed herein are not limited to such entertainment contexts. Indeed, the systems, methods, and concepts disclosed herein may be implemented in a wide variety of applications. The provision of examples in the present disclosure is to facilitate explanation of the disclosed techniques by providing instances of real-world implementations and applications. It should be appreciated that the embodiments disclosed herein may be useful in many applications, such as transportation systems (e.g., train systems), conveyer line systems, distribution systems, logistics systems, automation dynamic systems, and/or other industrial, commercial, and/or recreational systems, to name a few.

With this in mind, ride systems (e.g., amusement park-style rides) may employ ride vehicles that carry passengers along a ride path, for example, defined by a track. Over the course of the ride system, the ride path may include a number of features, including tunnels, turns, ascents, descents, loops, and so forth. The direction of travel of the ride vehicle may be defined by tracks of the ride path, as the ride vehicle may be in constant contact with the tracks defining the ride path. The ride experience associated with such a ride system may lack the element of surprise to repeated passengers because repeated passengers may be familiar with the ride path. For example, the direction of travel may remain the same during every run. These ride systems may include exposing a passenger to a consistent ride experience defined by the same turns, the same motion enhancing triggers, and the same ride trajectory for each run of the ride system. Repeated passengers may find such consistent ride experience boring or unexciting after engaging with the ride system multiple times. As such, there is a need to improve the excitement of the ride experience and to incorporate unpredictable ride themed experiences associated with such ride systems.

Additionally, servicing features on a portion of the track (e.g., closed-loop track) of a ride system may require that the entire ride system be shut down for maintenance because the ride vehicle will not be able to operate along the portion of track that requires servicing, irrespective of how minor the feature(s) or portions of the track being serviced may be. Closing the entire ride system to service these features may result in a loss of revenue, a loss of productivity, and false expectations for passengers looking forward to riding this ride system. Accordingly, it may be desirable to improve features of the ride system to increase the efficiency by which maintenance of a portion of the track may be performed, while improving the excitement associated with the ride system, the implementation of which may be difficult to coordinate in practice.

With the foregoing in mind, the systems and methods disclosed herein may enhance the ride experience and improve maintenance operations associated with the ride system. In an embodiment, a system includes one or more ride vehicles that may travel along a first ride path; hereinafter referred to as a "vehicle ride path," which may be defined along a first track. The system also includes one or more coasters that may travel along respective second ride paths; hereinafter referred to as "coaster ride paths," which may be defined along a second track different from the first track. The coaster ride paths may be separate from the vehicle ride paths. For example, the coaster ride path may be positioned on another plane (e.g., a plane lower, crosswise, or above) relative to a plane on which the vehicle ride vehicle is positioned.

As an exemplary embodiment, when the coaster ride path is positioned below the vehicle ride path, the coaster may remain hidden from a passenger in a ride vehicle on the vehicle ride path (e.g., because the coaster may be positioned under the vehicle ride path and/or separated by a surface). For example, the coaster may be positioned below a surface on which the vehicle ride path is positioned, such that when the coaster is moving separate from to the ride vehicle, the motion of the coaster along the coaster ride path may be masked by the surface.

A top of the coaster may couple with a portion of the vehicle ride path that is positioned above the coaster and that overlaps with the coaster ride path. In this manner, when the ride vehicle is positioned on the portion of the vehicle ride path that overlaps with the coaster, the ride vehicle may decouple from the vehicle ride path and couple to the coaster, as described in detail below.

After the coaster and the ride vehicle are coupled to one another, the coaster may transport the ride vehicle along the coaster ride path toward another portion on the vehicle ride path that also overlaps with the coaster ride path. After the coaster transports the ride vehicle to another overlapping portion on the vehicle ride path, the ride vehicle may decouple from the coaster and couple to the vehicle ride path at the additional overlapping portion. In this manner, a portion of the vehicle ride path (e.g., a segment between the overlapping portions) may be avoided (e.g., for scheduled maintenance of the portion of the vehicle ride path, for experience-enhancing effects, or for theming-related reasons) by transporting the ride vehicle via the coaster and along the coaster ride path to another portion of the vehicle ride path. Accordingly, employing the coaster described herein may enhance the operations and experience of a ride system.

As used herein, "overlapping portion" may refer to a portion of the ride path that overlaps in trajectory between the vehicle ride path and the coaster ride path. For example, "overlapping portion of the vehicle ride path" may refer to a portion of the vehicle ride path that has an overlapping trajectory with that of the coaster ride path. Similarly, "overlapping portion of the coaster ride path" may refer to a portion of the coaster ride path that has an overlapping trajectory with that of the vehicle ride path.

To help illustrate, FIG. 1 is a block diagram of an embodiment of various components of an amusement park 8, including a coaster, in accordance with aspects of the present disclosure. The amusement park 8 may include a ride system 10, which includes a vehicle ride path 12 that receives and guides a ride vehicle 20, such as by engaging with tires or rollers of the ride vehicle 20, and facilitates movement of the ride vehicle 20 along the vehicle ride path 12. In this manner, the vehicle ride path 12 may define a trajectory and direction of travel that may include turns, inclines, declines, ascents, descents, banks, loops, and the like. In an embodiment, the ride vehicle 20 may be passively driven or actively driven via a pneumatic system, a motor system, a tire drive system, a catapult system, fins coupled to an electromagnetic drive system, and the like.

The vehicle ride path 12 may receive more than one ride vehicle 20. The ride vehicles 20 may be separate from one another, such that they are independently controlled, or the ride vehicles 20 may be coupled to one another via any suitable linkage, such that motion of the ride vehicles 20 is coupled or linked. For example, the front end of one ride vehicle 20 may be coupled to a rear end of another ride vehicle 20 via a pin system. Each ride vehicle 20 in these and other configurations may hold one or more ride passengers 22.

The ride vehicle 20 may include a bogie system 30 having a chassis 31 and/or any number of experience enhancing features such as a turntable, a yaw drive system, and the like. While the embodiments disclosed herein are discussed as including passively-driven rollers or drive mechanisms, it should be understood that other motion enabling features, such as actively-driven or passively-driven tires, tracks, or actuatable components, may be employed. The bogie system 30 may include a suspension system, which may dampen motion or vibrations while the ride vehicle 20 is in operation, for example, by absorbing vibration and reducing centrifugal forces when the ride vehicle 20 executes certain motions, such as turns, at certain velocities. The suspension system may be actuated to enhance the ride experience for the ride passengers 22, for example, by stiffening, vibrating, or rotating components of the suspension system.

The chassis 31 may support a motor, a pneumatic driving system, an electrical system, a cab that houses the ride passengers 22, and the like. The chassis 31 may support the load of the various components of the ride vehicle 20 and the ride passengers 22. Furthermore, the chassis 31 may support a turntable, which may be positioned between the chassis 31 and a cab securing the ride passengers 22. In an embodiment, the turntable may be rigidly coupled to the cab, such that rotation of the turntable, in response to control instructions, results in a similar rotation of the cab relative to the chassis 31 to further enhance the ride experience.

The chassis 31 may support a yaw drive system, which may be positioned between the chassis 31 and the cab. In an embodiment, the yaw drive system may be integral to the turntable. The yaw drive system may receive control instructions to actuate the turntable in accordance with the control instructions. For example, the yaw drive system may cause the turntable to rotate the cab relative to the chassis 31. Furthermore, the yaw drive system may enable the cab to move relative to the chassis 31 in any suitable direction. To this end, the yaw drive system may enable the cab to rotate about or vibrate along a yaw axis, a pitch axis, or a roll axis. In this manner, the yaw drive system may enable six degrees-of-freedom motion of the cab relative to the chassis 31.

The ride vehicle 20 may include roller assemblies 32, which may include one or more rollers that engage with the tracks defining the vehicle ride path 12. For example, the roller assemblies 32 may include running rollers or actively-driven rollers to drive and/or guide motion of the ride vehicle 20 along the vehicle ride path 12, up-stop rollers that couple to the underside of the tracks, side friction rollers that couple to the side of the tracks, or any combination thereof.

Furthermore, the ride vehicle 20 may include various sensor assemblies 34. The sensor assemblies 34 may be communicatively coupled to a control system, as discussed in detail below. For example, the sensor assemblies 34 may include an infrared sensor to determine a position, velocity, and acceleration of the ride vehicle 20 along the vehicle ride path 12. The sensor assemblies 34 may include an orientation sensor, such as a gyroscope and/or accelerometer, configured to provide feedback for use in determining motion of any portion of the ride vehicle 20 (e.g., the cab), such as linear motion along three orthogonal axes, and the roll, pitch, and yaw of the ride vehicle 20. Additionally, the sensor assemblies 34 may include various sensors positioned near a vehicle securing mechanism 36 to determine a securing configuration of the ride vehicle 20. In this manner, the control system may receive information indicative of the various operating parameters of the ride system 10 via the sensor assemblies 34.

The vehicle securing mechanism 36 may include a hook, a ratchet system, a redundant locking mechanism, or any suitable device that maintains the ride vehicle 20 fixed in place with respect to a direction of travel along the vehicle ride path 12 when engaged. In addition or alternatively, the vehicle securing mechanism 36 may secure the ride vehicle 20 to a coaster, as described in detail below, when engaged. The vehicle securing mechanism 36 may include any suitable device that, when engaged, enables the roller assemblies 32 to maintain contact with tracks of the vehicle ride path 12 while the ride vehicle 20 traverses along the vehicle ride path 12. For example, the vehicle securing mechanism 36 may include a female mating member that may mate with a male mating member of a coaster 40, such that the female and male mating members may selectively lock with respect to one another, thereby securing the ride vehicle 20 to the coaster 40. Additionally, the vehicle securing mechanism 36 may actuate to disengage the ride vehicle 20 from the vehicle ride path 12 so as to decouple the ride vehicle 20 from the vehicle ride path 12 and to enable the ride vehicle 20 to be transported by the coaster 40 operating on a coaster ride path 42, as described in detail below.

The vehicle securing mechanism 36 may be positioned on the underside of the ride vehicle 20 (e.g., on the chassis 31) and/or may be positioned laterally inward or outward relative to the roller assemblies 32 to selectively secure the ride vehicle 20 to the tracks of the vehicle ride path 12 (e.g., secure the ride vehicle 20 to the tracks of the vehicle ride path 12 when the vehicle securing mechanism 36 is engaged and detach the ride vehicle 20 from the tracks of the vehicle ride path 12 when the vehicle securing mechanism 36 is disengaged). However, it should be appreciated that, in addition or alternatively to including the vehicle securing mechanism 36 on the underside of the ride vehicle 20, the vehicle securing mechanism 36 may be positioned anywhere on or proximate to the ride vehicle 20 (e.g., a longitudinal side of the ride vehicle 20, a lateral side of the ride vehicle 20, a top side of the ride vehicle 20, and so forth).

The ride system 10 may include one or more coasters 40 operating on respective coaster ride paths 42. For example, each coaster 40 may operate on a respective coaster ride path 42. The coasters 40 may each include roller assemblies 44, which may include one or more rollers that engage with the tracks defining the coaster ride path 42. For example, the roller assemblies 44 may include running rollers or actively-driven rollers to drive and/or guide motion of the coaster 40 along the coaster ride path 42, up-stop rollers that couple to the underside of the tracks of the coaster ride path 42, side friction rollers that couple to the side of the tracks, or any combination thereof.

To retrieve information indicative of the operating parameters of the coaster 40, the coaster 40 may include various sensor assemblies 46 communicatively coupled to a control system, as discussed in detail below. For example, the sensor assemblies 46 may include an infrared sensor to determine a position, velocity, and acceleration of the coaster 40, for example, with respect to the coaster ride path 42. Additionally, the sensor assemblies 46 may include various sensors positioned near a coaster securing mechanism 48 to determine whether the coaster securing mechanism 48 is activated and/or secured to one of the ride vehicles 20. In this manner, the control system may receive information indicative of the various operating parameters of the coaster 40 via the sensor assemblies 46 to facilitate securement of the ride vehicle 20 to the coaster 40 (via securing mechanisms 36 and/or 48), transportation of the ride vehicle 20 along the coaster ride path 42 from one portion of the vehicle ride path 12 to another portion of the vehicle ride path 12, and/or disengagement of the securing mechanism (e.g., securing mechanisms 36 and/or 48) to allow the ride vehicle 20 to continue along the vehicle ride path 12 after being transported via the coaster 40.

By way of illustration and as discussed in detail below with respect to FIG. 9, in an embodiment, the coaster ride path 42 may be defined and may extend between a first portion of the vehicle ride path 12 and a second portion of the vehicle ride path 12. In this manner, the coaster 40 may secure the ride vehicle 20 to the coaster 40 via the coaster securing mechanism 48 (and/or the vehicle securing mechanism 36) while the ride vehicle 20 is positioned on the first portion of the vehicle ride path 12. Thereafter, the coaster 42 may transport the secured ride vehicle 20 from the first portion of the vehicle ride path 12 to the second portion of the vehicle ride path 12 via the coaster ride path 42 extending there between.

As discussed below with respect to FIG. 9, in an embodiment, the coaster ride path 42 may be defined by a first end and a second end, such that the first end intersects the vehicle ride path 12 at a first overlapping portion and the second end intersects the vehicle ride path 12 at a second overlapping portion. In this manner, the coaster 40 may travel between the first and second portions of the vehicle ride path 12 to transport the ride vehicle 20 between the first and second portions of the vehicle ride path 12 along the coaster ride path 42 instead of along the vehicle ride path 12. For example, the coaster 40 may receive the ride vehicle 20 from the first portion of the vehicle ride path 12 when the ride vehicle 20 is positioned on the first portion of the vehicle ride path 12. After securing the ride vehicle 20 via the vehicle securing mechanism 36 or the coaster securing mechanism 48, the coaster 40 may transport the ride vehicle 20 along the coaster ride path 42 to the second portion of the vehicle ride path 12.

In an embodiment, and as discussed below with respect to FIG. 9, the coaster ride path 42 may overlap with a first vehicle ride path and with a second vehicle ride path that is separate from the first vehicle ride path. In this manner, the coaster 40 may receive the ride vehicle 20 from an overlapping portion of the first vehicle ride path when the ride vehicle 20 is positioned on the overlapping portion of the first vehicle ride path. After securing the ride vehicle 20 via the vehicle securing mechanism 36 or the coaster securing mechanism 48, the coaster 40 may transport the ride vehicle 20 along the coaster ride path 42 from the overlapping portion of the first vehicle ride path to an overlapping portion of the second vehicle ride path. As such, the coaster 40 may facilitate transportation of ride vehicles 20 between different vehicle ride paths 12 and/or between different portions of the same vehicle ride path.

The amusement park 8 may include a control system 50 that is communicatively coupled (e.g., via wired or wireless features) to the ride vehicle 20, the coaster 40 and the features on the ride system 10. The amusement park 8 may include more than one control system 50. For example, the amusement park 8 may include one control system 50 associated with the ride vehicle 20, another control system 50 associated with the coaster 40, a base station control system 50, and the like, such that each of the control systems 50 is communicatively coupled to other control systems 50 (e.g., via respective transceiver or wired connections).

The control system 50 may be communicatively coupled to one or more ride vehicles 20 of the amusement park 8 via any suitable wired and/or wireless connection (e.g., via transceivers). The control system 50 may control various aspects of the amusement park 8. For example, in some portions of the vehicle ride path 12, the control system 50 may control or adjust the direction of travel, velocity, and acceleration of the ride vehicle 20 to cause the ride vehicle 20 to stop on an overlapping portion of the vehicle ride path 12. Then, the control system 50 may disengage the vehicle securing mechanism 36 to decouple the ride vehicle 20 from the vehicle ride path 12 and engage the vehicle securing mechanism 36 and/or the coaster securing mechanism 48 to couple the ride vehicle 20 to the coaster 40. The control system 50 may then actuate the coaster 40 to transport the ride vehicle 20 to another portion of vehicle ride path 12 or to another vehicle ride path 12. To facilitate control, the control system 50 may receive data from the sensor assemblies 34, 46. In an embodiment, the control system 50 may be an electronic controller having electrical circuitry configured to process data associated with the ride vehicle 20 and or the coaster 40, for example, from sensor assemblies 34 and 46, respectively, via the transceivers. Furthermore, the control system 50 may be communicatively coupled to various components of the amusement park 8 (e.g., park attractions, park controllers, and wireless networks).

The control system 50 may include a memory device 52 and a processor 54, such as a microprocessor. The control system 50 may also include one or more storage devices 56 and/or other suitable components. The processor 54 may be used to execute software, such as software for controlling the ride vehicle(s) 20 and the coaster 40. Moreover, the processor 54 may include multiple microprocessors, one or more "general-purpose" microprocessors, one or more special-purpose microprocessors, and/or one or more application-specific integrated circuits (ASICs), or some combination thereof. For example, the processor 54 may include one or more reduced instruction set (RISC) processors.

The memory device 52 may include a volatile memory, such as random-access memory (RAM), and/or a nonvolatile memory, such as read-only memory (ROM). The memory device 52 may store a variety of information and may be used for various purposes. For example, the memory device 52 may store processor-executable instructions (e.g., firmware or software) for the processor 54 to execute, such as instructions for controlling components in the ride system 10, such as features of the ride vehicle 20, the coaster 40, and so forth. For example, the instructions may cause the processor 54 to control motion of the ride vehicle 20 and the coaster 40 to subject the passengers 22 to ride-enhancing motions, while also transporting the ride vehicle 20 to other portions of the vehicle ride path 12 in a manner that is blind to the passengers 22 to enhance the overall ride experience.

The storage device(s) 56 (e.g., nonvolatile storage) may include ROM, flash memory, a hard drive, or any other suitable optical, magnetic, or solid-state storage medium, or a combination thereof. The storage device(s) 56 may store data (e.g., passenger 22 information, data associated with the amusement park 8, data associated with the vehicle ride path trajectory), instructions (e.g., software or firmware for controlling the ride vehicle 20, the vehicle securing mechanism 36, the coaster 40, and/or the coaster securing mechanism 48), and any other suitable information.

The ride system 10 may include a ride environment 60, which may include multiple and differing combinations of environments. The ride environment 60 may include the type of ride (e.g., dark ride, water coaster, roller coaster, VR experience, or any combination thereof) and/or associated characteristics (e.g., theming) of the type of ride. For example, the ride environment 60 may include aspects of the ride system 10 that add to the overall theming and/or experience associated with the ride system 10.

The ride system 10 may include a motion-based environment 62, in which the passengers 22 are transported or moved by the ride system 10. For example, the motion-based environment 62 may include a flat ride 64 (e.g., a ride that moves passengers 22 substantially within a plane that is generally aligned with the ground, such as by the ride vehicle 20 translating along a substantially flat vehicle ride path 12 or the coaster 40 transporting the ride vehicle 20 along a flat coaster ride path 42), a gravity ride 66 (e.g., a ride where motion of the passengers 22 has at least a component of movement along the gravity vector, such as the coaster 40 transporting the ride vehicle 20 between one vehicle ride path 12 on a first level and another vehicle ride path 12 on a second level higher than the first level), and/or a vertical ride 68 (e.g., a ride that displaces passengers 22 in a vertical plane with respect to a fixed point).

The ride system 10 may include a motionless environment 70, in which the passengers 22 are not substantially transported or displaced by the ride system 10. For example, the motionless environment 70 may include a virtual reality (V/R) feature 72 (e.g., the passenger 22 may sit on a seat that vibrates or remains stationary while wearing a virtual reality (V/R) headset displaying a VR environment or experience) and/or a different kind of simulation 74. In an embodiment, the ride vehicle 20 may come to a stop along the vehicle ride path 12, such that the ride experience may include aspects of the motionless environment 70 for a portion of the duration of the ride experience. While the passengers 22 may not move substantially in the motionless environment 70, virtual reality and/or simulation effects may cause disorientation of the passengers 22, which may be enhanced and contrasted by motion-based distortion experienced by passengers 22. To that end, it should be understood that the ride system 10 may include both motion-based and motionless environments 62 and 70, which make the coaster 40 desirable for enhancing the ride experience.

FIG. 2 is a schematic of an embodiment of the ride system 10, in accordance with aspects of the present disclosure. The ride system 10 may include multiple ride vehicles 20 coupled together via linkages to join passengers 22 riding in corresponding ride vehicles 20 in a common ride experience. The ride vehicles 20 may not be coupled to one another and may instead move independently of one another, for example, along respective and/or separate vehicle ride paths 12. In an embodiment, ride vehicles 20 may move together in groupings or as sets of ride vehicles 20. For example, a first set of ride vehicles 20 (e.g., three ride vehicles) may move along a first vehicle ride path 12, and a second set of ride vehicles 20 (e.g., five ride vehicles) may move along a second vehicle ride path 12. It should be understood that the control system 50 may instruct the ride vehicles 20 to travel along the one or more vehicle ride paths 12 in any desired manner.

The vehicle ride path 12 may include any features that define a vehicle direction of travel 76 (i.e., the direction of travel of the ride vehicle 20). For example, the vehicle ride path 12 may include a track, a rail, a road, a chute, or any combination thereof. For example, the vehicle ride path 12 may define the movement (e.g., direction, speed, and/or orientation) of the ride vehicle 20 as the ride vehicle 20 progresses along the vehicle ride path 12, similar to a train on train tracks.

The ride system 10 may also include the coaster 40 that includes a corresponding roller assembly 44. The roller assembly 44 may be compatible with tracks, rails, roads, chutes, or any combination there, associated with the coaster ride path 42. To that end, in an embodiment, the coaster 40 may travel along a coaster direction of travel 78 (i.e., the direction of travel of the coaster 40) defined by the coaster ride path 42. While the illustrated embodiment includes the vehicle ride path 12 and the coaster ride path 42 defined by respective paths (e.g., tracks), it should be appreciated that the ride vehicle 20, the coaster 40, or both, may freely travel along an unrestricted path at least in some portions of the ride system 10.

The vehicle ride path 12 and the coaster ride path 42 may overlap at an overlapping portion 80. For example, the vehicle ride path 12 may be defined along a plane or contour positioned at a vertical position different from a plane or contour defining the coaster ride path 42. The overlapping portion 80 may refer to the portion along which the coaster ride path 42 intersects with the vehicle ride path 12 in such a manner that the coaster 40 (e.g., the top 79 of the coaster 40) may couple to the vehicle ride path 12 (e.g., the underside of the vehicle ride path 12) to receive the ride vehicle 20. Alternatively, the coaster 40 (e.g., the top 79 of the coaster 40) may couple to the chassis 31 of the ride vehicle 20. After the coaster 40 receives and secures the ride vehicle 20, the control system 50 may send a signal to the coaster 40 to transport the ride vehicle 20 along the coaster ride path 42, for example, along the coaster direction of travel 78.

Figure 3:
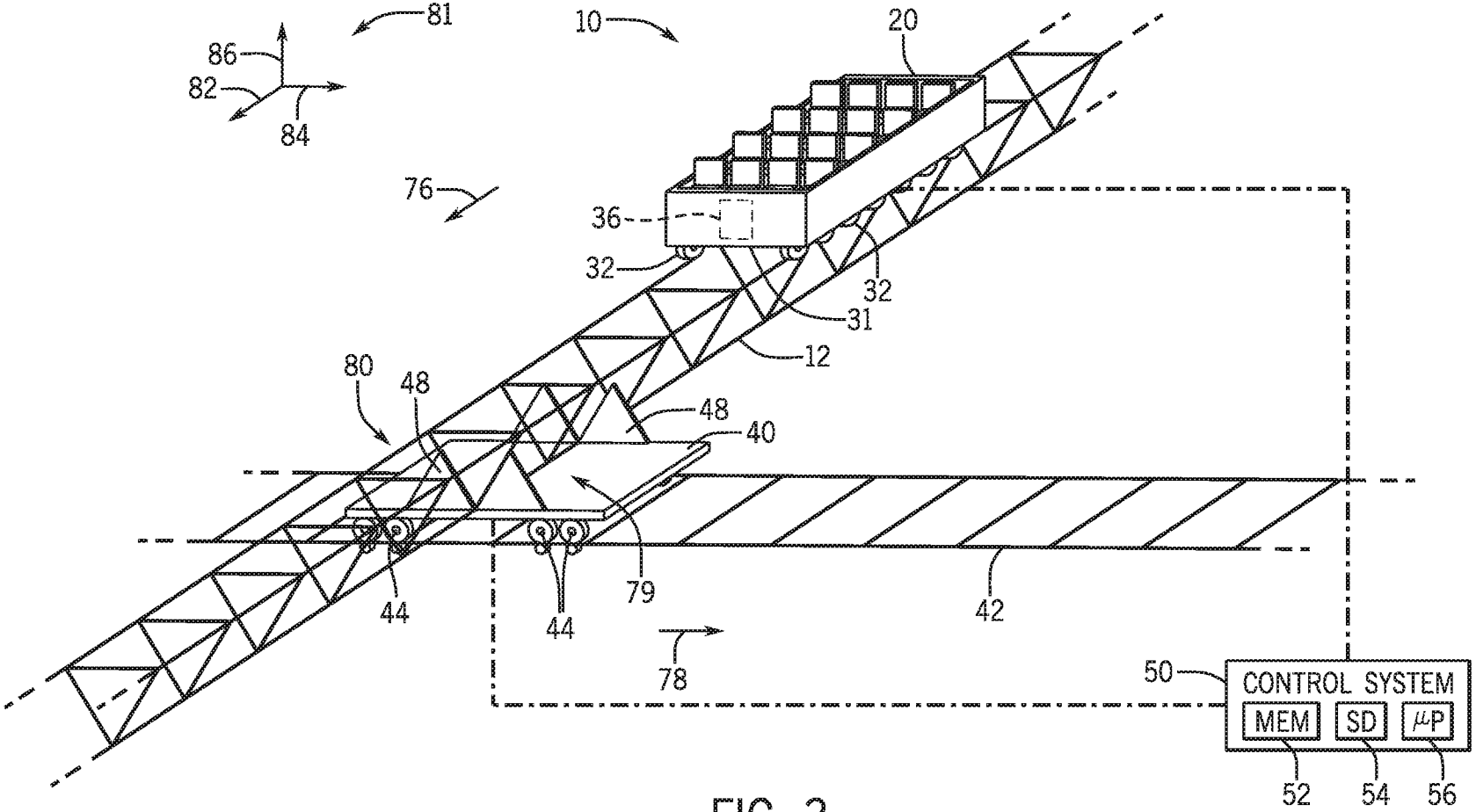
FIG. 3 is schematic of an embodiment of the ride vehicle of FIG. 1 and the coaster of FIG. 1 operating in the ride system of FIG. 2, in accordance with aspects of the present disclosure.

FIG. 3 is a schematic of an embodiment of the ride vehicle 20 and the coaster 40 operating in the ride system 10 and illustrating the ride vehicle 20 traveling along the vehicle direction of travel 76, in accordance with aspects of the present disclosure. To facilitate discussion, the following description may refer to a coordinate system 81 including a longitudinal axis 82, a lateral axis 84, and a vertical axis 86, where the axes of the coordinate system 81 are generally orthogonal with respect to one another. In the illustrated embodiment, the vehicle direction of travel 76 is oriented substantially parallel to or along the longitudinal axis 82.

The control system 50 may instruct the ride vehicle 20 to travel along the vehicle ride path 12 in the vehicle direction of travel 76 and decelerate to a stop at the overlapping portion 80. When the ride vehicle 20 decelerates to a stop, the control system 50 may send a signal to the coaster 40 to actuate the coaster 40 to position the coaster 40 on the coaster ride path 42 under the vehicle ride path 12 and at the overlapping portion 80. In this manner, the coaster 40 may be ready to couple to the ride vehicle 20. The ride vehicle 20 may include a stopping device that enables the ride vehicle 20 to stop on the overlapping portion 80 at a desired position. Alternatively or in addition, the stopping device may be separate from the vehicle securing mechanism 36 and the coaster securing mechanism 48. For example, the roller assemblies 32 may be associated with a braking system configured to decelerate the ride vehicle 20 on the vehicle ride path 12.

Figure 4:
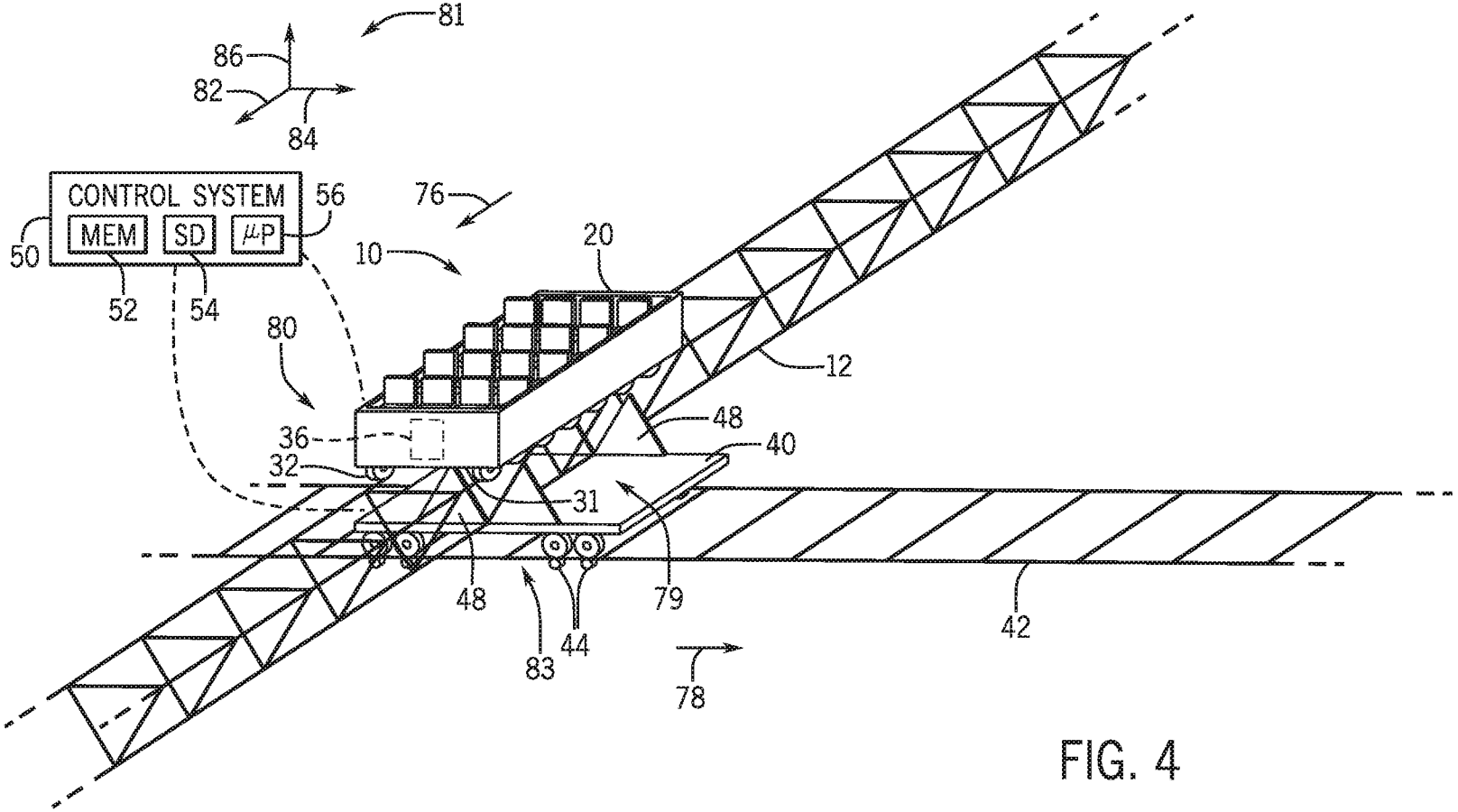
FIG. 4 is a schematic of an embodiment of the coaster of FIG. 1 receiving the ride vehicle of FIG. 1 from a vehicle ride path, in accordance with aspects of the present disclosure.
Figure 5:
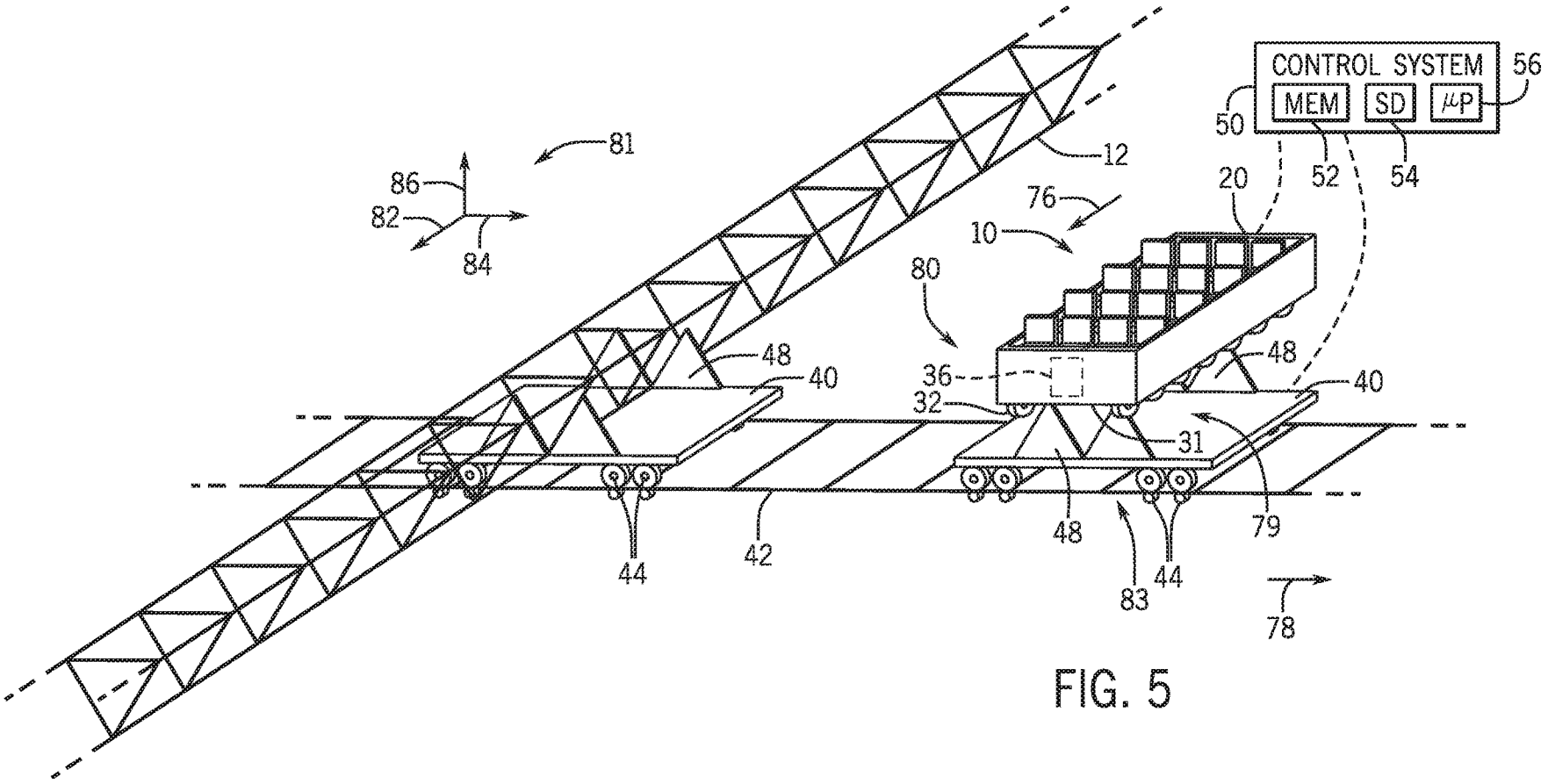
FIG. 5 is a schematic of an embodiment of the coaster of FIG. 1 transporting the ride vehicle of FIG. 1 along a coaster ride path to another portion of the vehicle ride path of FIG. 4, in accordance with aspects of the present disclosure.

As mentioned above, the coaster 40 may travel along the coaster direction of travel 78. As illustrated, the coaster direction of travel 78 is oriented substantially parallel to or along the lateral axis 84. While the embodiments illustrated in FIGS. 3-5 depict the coaster ride path 42 as oriented substantially perpendicular to the vehicle ride path 12, it should be understood that the coaster ride path 42 may be oriented at any angle relative to the vehicle ride path 12. For example, the coaster 40 may travel along the coaster ride path 42 in the coaster direction of travel 78 and decelerate to a stop on the overlapping portion 80 (e.g., by a braking system). The control system 50 may be communicatively coupled to aspects of the ride system 10, such as the ride vehicle 20, the coaster 40, and their corresponding features. In this matter, the control system 50 may coordinate motion of the ride vehicle 20 and the coaster 40 to transport the ride vehicle 20 (by using the coaster 40) to overlapping portions along the vehicle ride path 12 in a thrilling and experience-enhancing manner.

To that end, FIG. 4 is a schematic of an embodiment of the coaster 40 receiving the ride vehicle 20 from the vehicle ride path 12, in accordance with aspects of the present disclosure. The control system 50 may send a signal to a braking system of the ride vehicle 20 or the vehicle ride path 12 to decelerate the ride vehicle 20 to a stop at a desired position on the vehicle ride path 12 (e.g., such that the ride vehicle 20, when stopped, is positioned on the overlapping portion 80). The control system 50 may send another signal to the coaster 40, causing the coaster 40 to travel along the coaster ride path 42 and decelerate to a stop at the overlapping portion 80. Indeed, the control system 50 may coordinate operation of the coaster 40 and the ride vehicle 20, such that the coaster 40 and the ride vehicle 20 may decelerate to the overlapping portion 80 at the same time. Alternatively, the control system 50 may coordinate operation of the coaster 40 and the ride vehicle 20 by instructing the coaster 40 to be positioned at the overlapping portion 80 prior to the ride vehicle 20 decelerating to a stop at the overlapping portion 80. In this manner, the coaster 40 may be ready to receive and secure the ride vehicle 20.

After the ride vehicle 20 decelerates to a stop at the overlapping portion 80, the control system 50 may send signals to feature(s) of the ride vehicle 20 and/or tracks of the vehicle ride path 12 on the overlapping portion 80 to decouple the ride vehicle 20 from the vehicle ride path 12. The control system 50 may instruct the tracks of the vehicle ride path 12 to rotate about the longitudinal axis 82, such that the ride vehicle 20 slides off the vehicle ride path 12 and onto the coaster 40.

In an embodiment, the vehicle securing mechanism 36 may include a restraining system that, when engaged, limits the ride vehicle 20 to movement along the direction of the tracks defining the vehicle ride path 12 (e.g., along the vehicle direction of travel 76). The control system 50 may instruct the vehicle securing mechanism 36 to disengage, such that the ride vehicle 20 is free to move relative to the tracks of the vehicle ride path 12. In this manner, the ride vehicle 20 may decouple from the vehicle ride path 12, such that the coaster 40 may receive the ride vehicle 20 and secure the ride vehicle 20 to the coaster 40.

After receiving the ride vehicle 20 from the vehicle ride path 12, the coaster 40 may receive signals (e.g., from the control system 50) indicative of instructions to secure the ride vehicle 20 to the coaster 40 (e.g., the top 79 of the coaster 40) via the coaster securing mechanism 48. Alternatively, the coaster 40 (e.g., the top 79 of the coaster 40) may couple to the chassis 31 of the ride vehicle 20. As mentioned above, the vehicle securing mechanism 36 and the coaster securing mechanism 48 may include a female-male securing configuration 83, such that when the vehicle securing mechanism 36 and the coaster securing mechanism 48 are engaged, the male configuration couples to the female configuration to secure the ride vehicle 20 to the coaster 40. In this manner, the ride vehicle 20 may transition from being coupled to the vehicle ride path 12 to being secured to the coaster 40.

To continue illustration of the operation and functionality of the coaster 40, FIG. 5 is a schematic of an embodiment of the coaster 40 transporting the ride vehicle 20 along the coaster ride path 42 to another portion of the vehicle ride path 12, in accordance with aspects of the present disclosure. As illustrated, after the coaster 40 receives and secures the ride vehicle 20 thereto, the control system 50 may instruct the coaster 40 to travel along the coaster ride path 42 (e.g., along the coaster direction of travel 78) to transport the ride vehicle 20 to another portion of the vehicle ride path 12. For example, the control system 50 may instruct the coaster 40 to travel to another overlapping portion different from the overlapping portion 80 where the coaster 40 received the ride vehicle 20. In this manner, a portion of the vehicle ride path 12 between the two overlapping portions 80 may be avoided (e.g., for maintenance purposes, for experience enhancing purposes, for theming purposes, and so forth). In other words, utilization of the coaster 40 and the coaster ride path 42 as described herein enables transportation of the ride vehicle 20 to different portions of the ride vehicle path 12 without the ride vehicle 20 traveling along certain segments of the vehicle ride path 12.

As mentioned above, the coaster 40 may remain hidden from the passengers 22 within the ride vehicle 20 (e.g., because the coaster 40 may be positioned in a floor under the vehicle ride path 12), such that the passengers 22 may be unaware of the mechanism used to transport the ride vehicle 20 away from the vehicle ride path 12 and then back onto the vehicle ride path 12. For example, a surface 41 may be level with the vehicle ride path 12 to mask the coaster 40 from the passengers 22.

In response to the coaster 40 transporting the ride vehicle 20 to the other overlapping portion, the control system 50 may position another coaster 40 on the overlapping portion 80. The other coaster 40 may be on the overlapping portion 80 ready to couple to another ride vehicle 20. In this manner, a plurality of coaster 40 may coordinate with each other to transport many ride vehicles 20 operating in the ride system 10.

After the coaster 40 transports the ride vehicle 20 to the other overlapping portion, the control system 50 may disengage the vehicle securing mechanism 36 or the coaster securing mechanism 48 to decouple the ride vehicle 20 from the coaster 40. The control system 50 may also instruct the vehicle securing mechanism 36 to couple and secure the ride vehicle 20 to the vehicle ride path 12. That is, the control system 50 send a signal to the locking mechanism(s) to re-engage the locking mechanism(s), as described above, to secure the ride vehicle 20 to the vehicle ride path 12 to enable motion of the ride vehicle 20 along the vehicle ride path 12. While FIGS. 3-5 illustrate motion of the ride vehicle 20 along the longitudinal axis 82 and the lateral axis 84, it should be appreciated that the techniques disclosed herein may be employed to also facilitate vertical motion of the ride vehicle 20 (e.g., via the vehicle ride path 12 and/or via the coaster ride path 42).

Figure 6:
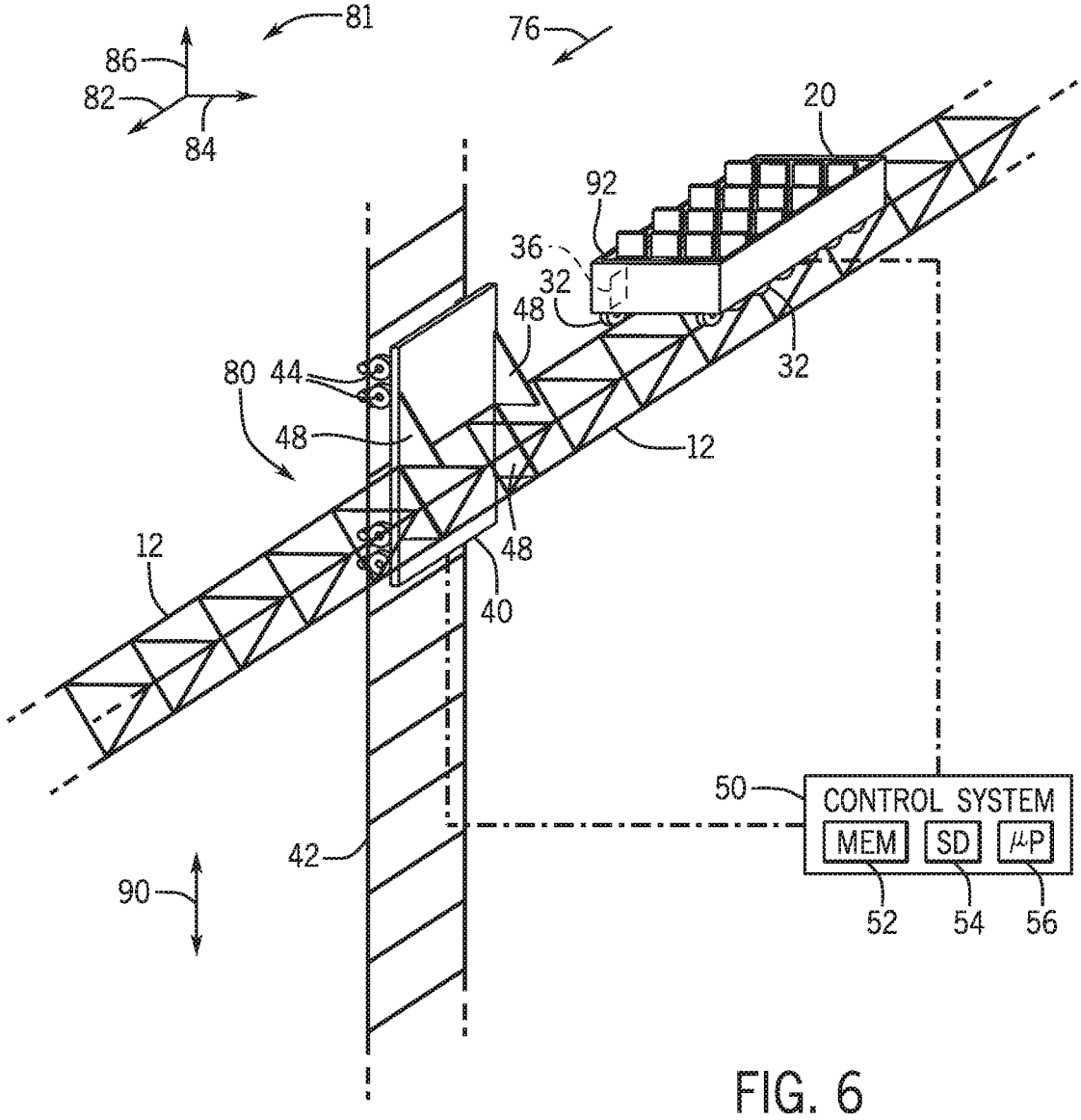
FIG. 6 is schematic of an embodiment of the ride vehicle of FIG. 1 and the coaster of FIG. 1 operating in the ride system of FIG. 2 to facilitate vertical motion between vehicle ride paths, in accordance with aspects of the present disclosure.
Figure 7:
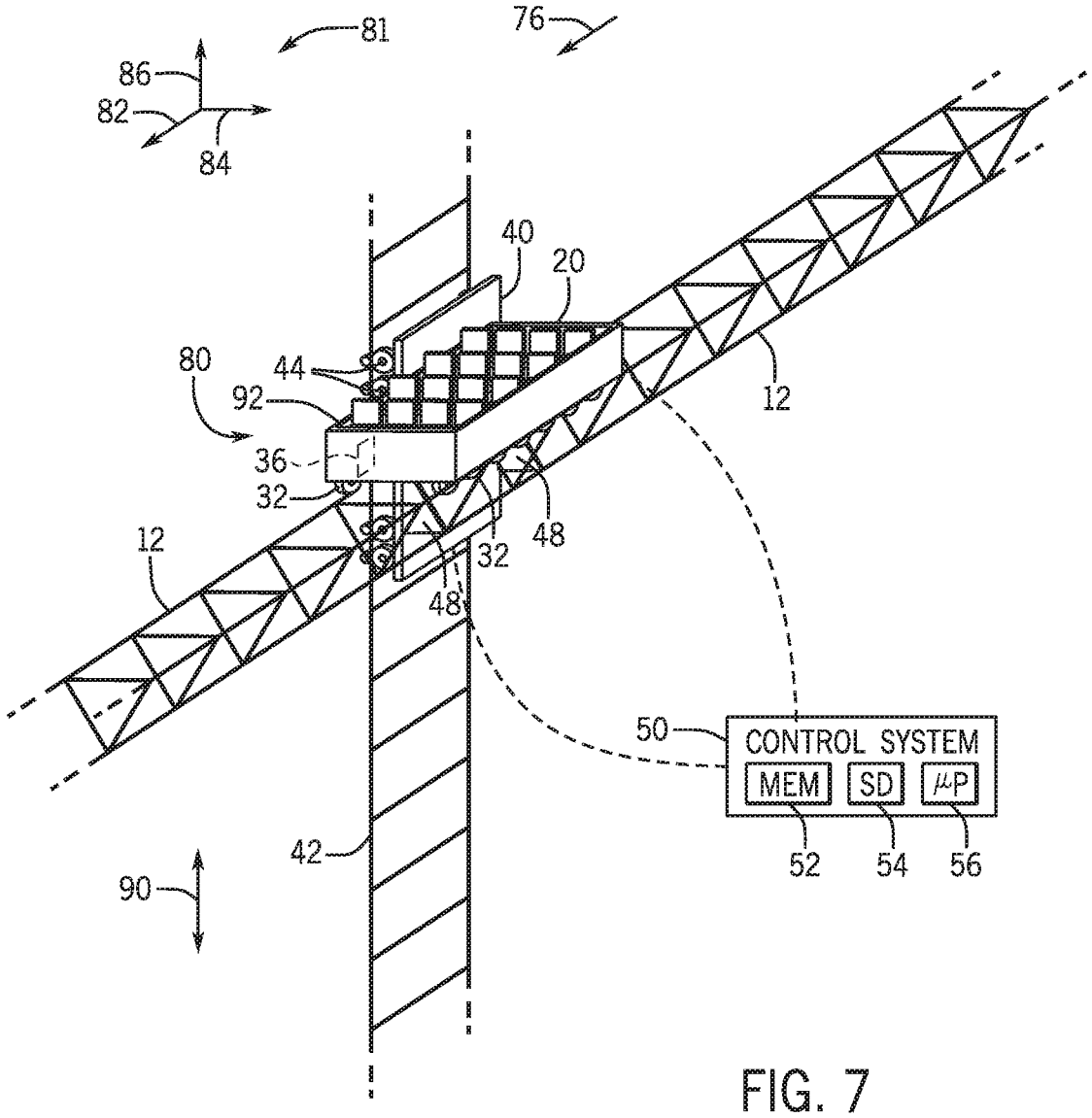
FIG. 7 is a schematic of an embodiment of the coaster of FIG. 1 receiving the ride vehicle of FIG. 1 from a vehicle ride path, in accordance with aspects of the present disclosure.
Figure 8:
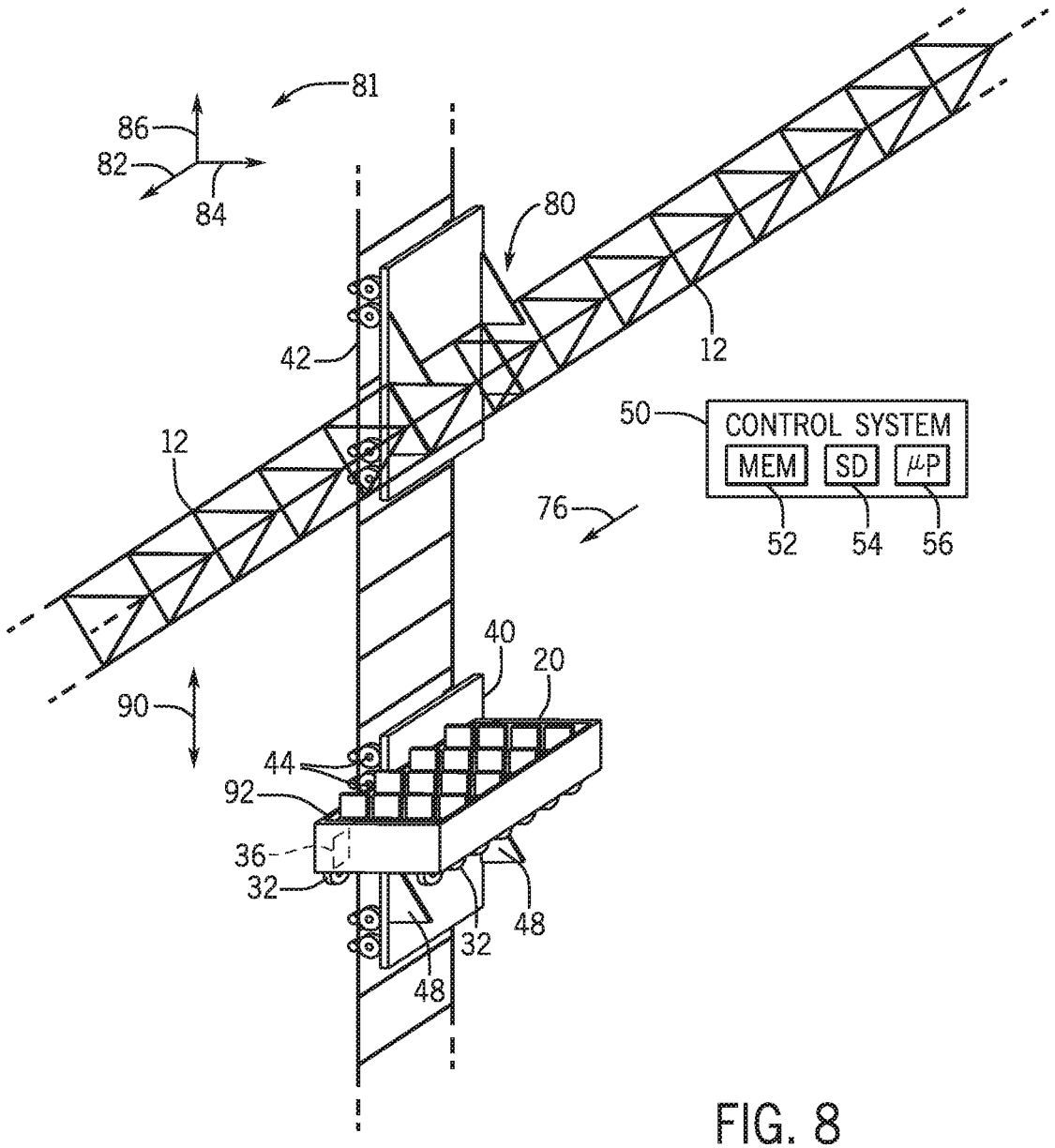
FIG. 8 is a schematic of an embodiment of the coaster of FIG. 1 vertically transporting the ride vehicle of FIG. 1 along a coaster ride path to another portion of a vehicle ride path, in accordance with aspects of the present disclosure.

To that end, FIGS. 6-8 illustrate schematics of the coaster 40 and the ride vehicle 20 operating in an embodiment of ride system 10 to enable vertical motion of the ride vehicle 20, in accordance with aspects of the present disclosure. In particular, FIG. 6 is a schematic of an embodiment of the ride vehicle 20 and the coaster 40 operating in the ride system 10 to facilitate motion of the ride vehicle 20 along a vertical direction of travel 90 between vehicle ride paths 12. FIG. 7 is a schematic of an embodiment of the coaster 40 receiving the ride vehicle 20 from the vehicle ride path 12, in accordance with aspects of the present disclosure. FIG. 8 is a schematic of an embodiment of the coaster 40 vertically transporting the ride vehicle 20 along the coaster ride path 42 to another portion of vehicle ride path 12, in accordance with aspects of the present disclosure. FIGS. 6-8 are discussed concurrently below.

The ride vehicle 20 may include any number of vehicle securing mechanisms 36. For example, as discussed above, the ride vehicle 20 may include one vehicle securing mechanism 36 on the underside (e.g., on the chassis 31) of the ride vehicle 20. In addition, the ride vehicle 20 may include another vehicle securing mechanism 36 on a lateral side 92 of the ride vehicle 20. In this manner, the lateral side 92 of the ride vehicle 20 may couple to the coaster 40, such that the ride vehicle 20 remains fixed to the coaster 40 while the coaster 40 vertically transports the ride vehicle 20 along the vertical direction of travel 90.

The coaster 40 may be positioned on the overlapping portion 80 as the ride vehicle 20 approaches the overlapping portion 80 on the vehicle ride path 12. After the control system 50 instructs the ride vehicle 20 to decelerate to a stop onto the overlapping portion 80, the control system 50 may instruct the coaster securing mechanism 48 to couple to the vehicle securing mechanism 36 on the lateral side 92. The control system 50 may also instruct the vehicle securing mechanism 36 on the underside of the ride vehicle 20 to decouple from the vehicle ride path 12 (e.g., from the tracks of the vehicle ride path 12).

After the ride vehicle 20 is coupled and secured to the coaster 40 and after the ride vehicle 20 is decoupled from the vehicle ride path 12, the control system 50 may send a signal to the coaster 40 to actuate the coaster 40 to travel along the coaster ride path 42 (e.g., along the vertical direction of travel 90) and thereby transport the ride vehicle 20 to another portion of the vehicle ride path 12 positioned at another vertical distance relative to the location of the vehicle ride path 12 from which the coaster 40 received the ride vehicle 20. For example, the control system 50 may instruct the coaster 40 to travel to another overlapping portion different from the overlapping portion 80 from which the coaster 40 received the ride vehicle 20. In this manner, a portion of the vehicle ride path 12 may be avoided (e.g., for maintenance purposes, for experience enhancing purposes, for theming purposes, and so forth).

As mentioned above, the coaster 40 may be hidden by a surface 41 from the passengers 22 (FIGS. 1 and 2) within the ride vehicle 20 (e.g., because the coaster 40 may be positioned inside a wall on which the vehicle ride path 12 is positioned), such that the passengers 22 may be unaware of the mechanism used to vertically transport the ride vehicle 20 away from the vehicle ride path 12 and to another portion of the vehicle ride path 12 or to a ride path positioned on another floor or another vertical position.

In response to the coaster 40 transporting the ride vehicle 20 to the other overlapping portion, the control system 50 may position another coaster 40 on the overlapping portion 80. The other coaster 40 may be on the overlapping portion 80 ready to couple to another ride vehicle 20. In this manner, a plurality of coaster 40 may coordinate with each other to transport many ride vehicles 20 operating in the ride system 10.

After the coaster 40 transports the ride vehicle 20 to another overlapping portion, the control system 50 may disengage the vehicle securing mechanism 36 and/or the coaster securing mechanism 48 to decouple the ride vehicle 20 from the coaster 40. The control system 50 may also instruct the vehicle securing mechanism 36 to engage and secure the ride vehicle 20 to the vehicle ride path 12. That is, the control system 50 send a signal to the securing mechanism(s) to re-engage the securing mechanism(s) of the vehicle securing mechanism 36, as described above, and thereby secure the ride vehicle 20 to the vehicle ride path 12 and enable motion of the ride vehicle 20 along the vehicle ride path 12.

FIG. 9 is a graphical representation 100 of an embodiment of the ride system 10, including one or more coaster ride paths 42 and one or more vehicle ride paths 12, in accordance with aspects of the present disclosure. As described above, the vehicle ride paths 12 and the coaster ride paths 42 may overlap with one another at a plurality of overlapping portions 80. To facilitate illustration, in the graphical representation 100, the vehicle ride paths 12 are represented with solid lines, the coaster ride paths 42 are represented with dotted lines, communication with the control system 50 is represented with dashed-dotted lines, and the overlapping portions 80 are represented as solid squares. Furthermore, the directions of ride vehicle 20 travel along the vehicle ride path 20 and/or the coaster ride path 42 are defined with arrows along the vehicle ride paths 12 and coaster ride paths 42. However, it should be appreciated that the vehicle ride paths 12 and/or the coaster ride paths 42 may be bidirectional or configured to enable ride vehicle 20 motion in directions opposite to those shown.

The ride system 10 may include a ride station 102 on which ride passengers 22 (FIGS. 1, 2) may wait in a queue line before boarding the ride vehicle 20 (FIGS. 1-8). For example, after traveling along the vehicle ride paths 12 and the coaster ride paths 42, the ride vehicle 20 may decelerate along a break run 104 of the vehicle ride path 12 to come to a stop at the ride station 102. Ride passengers 22 may egress out of the ride vehicle 20 to allow the next set of ride passengers 22 (e.g., waiting in a queue line) to ingress into the ride vehicle 20 and experience the thrilling experience of the ride system 10.

As mentioned above, the ride vehicle 20 may receive control signals from the control system 50 to drive motion of the ride vehicle 20 along the vehicle ride path 12 and to coordinate motion of the ride vehicle 20 with motion of the coaster 40 to enable transportation of the ride vehicle 20 from one overlapping portion 80 to another overlapping portion 80 by way of the coaster ride path 42. In this manner, portions of the vehicle ride path 12 or portions of the coaster ride path 42 may be avoided by the ride vehicle 20 (e.g., for theme enhancing reasons, for maintenance purposes, and so forth).

By way of example, the ride vehicle 20 may be transported by the coaster 40 along a first portion 106 of the coaster ride path 42. The coaster 40 may stop at a first overlapping portion 110, the ride vehicle 20 may decouple from the coaster 40, and the ride vehicle 20 may couple to the vehicle ride path 12 to travel along a first portion 112 of the vehicle ride path 12. Thereafter, the ride vehicle 20 may decelerate to a stop on a second overlapping portion 114, and the ride vehicle 20 may decouple from the vehicle ride path 12, couple to the coaster 40, and continue traveling along the coaster ride path 42 along a second portion 116 of the coaster ride path 42. In this manner, a third portion 118 (e.g., positioned and extending between the first portion 106 and second portion 116) of the coaster ride path 42 may be avoided by the ride vehicle 20.

Alternatively, while the control system 50 is controlling the coaster 40 to transport the ride vehicle 20, the coaster 40 may not stop on the first overlapping portion 110 or second overlapping portion 114 and instead may continue traveling along the coaster ride path 42. In this manner, the first portion 112 of the vehicle ride path 12 may be avoided. In other words, the ride vehicle 20 may not travel along the first portion 112 of the vehicle ride path 12. While the graphical representation 100 generally illustrates ride vehicle 20 motion along a common plane, it should be appreciated that the present techniques may be employed to transport the ride vehicle 20 along and amongst various floors (e.g., to avoid certain portions of the vehicle ride path 12 or provide passengers 22 with a thrilling and unique experience).

Furthermore, the ride system 10 may include a maintenance facility 130. For example, when the ride vehicles 20 or coasters 40 are due for maintenance, the path of travel of the ride vehicle 20 or the coaster 40, respectively, may be diverted to direct the ride vehicle 20 or the coaster 40 into the maintenance facility 130, where the ride vehicle 20 or the coaster 40 may be serviced. The maintenance facility 130 may store various maintenance equipment (e.g., for servicing the ride vehicle 20, the coasters 40, the vehicle ride paths 12, and/or the coaster ride paths 42), additional coasters 40, additional ride vehicles 20, and so forth.

FIG. 10 is a flow diagram 200 of an embodiment of a method for transporting the ride vehicle 20 (FIGS. 1-8) from one portion of the vehicle ride path 12 (FIGS. 1-8) to another portion of the vehicle ride path 12, in accordance with aspects of the present disclosure. The process of the flow diagram 200 may be implemented by a processor-based device, such as a controller of the control system 50 (FIGS. 1-9) described above.

With the foregoing in mind, the control system 50 may send a signal to the coaster 40 to actuate (process block 202) the coaster 40 operating on the coaster ride path 42 (FIGS. 1-9) (e.g., a coaster track) and move the coaster 40 to intersect the vehicle ride path 12 (FIGS. 1-9) at a target position (i.e., overlapping portion 80 of the coaster ride path 42 and vehicle ride path 12 [FIGS. 2-9]). The coaster 40 may remain at the overlapping portion 80 until it receives the ride vehicle 20 from the vehicle ride path 12.

While the coaster 40 is at the overlapping portion 80, the control system 50 may control motion of the ride vehicle 20 by sending a signal to the ride vehicle 20 to decelerate the ride vehicle 20 to a stop onto or at the overlapping portion 80. That is, the control system 50 may position (process block 204) the ride vehicle 20 on the overlapping portion 80 and on (or proximate to) the coaster 40. When both the ride vehicle 20 and the coaster 40 are at the overlapping portion 80, the coaster 40 may be positioned under the ride vehicle 20 (e.g., to transport the ride vehicle 20 along the coaster ride path 42). In an embodiment, when both the ride vehicle 20 and the coaster 40 are at the overlapping portion 80, the coaster 40 may be positioned on the lateral side of the ride vehicle 20 (e.g., to execute vertical motion along the coaster ride path 42).

While the coaster 40 is at the overlapping portion 80, the control system 50 may send a signal to the vehicle securing mechanism 36 to disengage the vehicle securing mechanism 36 (FIGS. 1, 3-8) and decouple the ride vehicle 20 from the vehicle ride path 12. The control system 50 may also send a signal to engage the vehicle securing mechanism 36 and/or the coaster securing mechanism 48 to couple and secure the ride vehicle 20 to the coaster 40. That is, the control system 50 may cause the (process block 206) securing mechanism(s) to engage, as described above, in order to secure the ride vehicle 20 to the coaster 40.

After the control system 50 secures the ride vehicle 20 to the coaster 40, the control system 50 may send a signal to the coaster 40 to actuate (process block 208) the coaster 40 to transport the ride vehicle 20 along the coaster ride path 42 to another portion of the vehicle ride path 12 or to another, separate vehicle ride path 12. For example, the control system 50 may instruct the coaster 40 to travel (e.g., along the longitudinal axis 82 [FIGS. 3-8], the lateral axis 84 [FIGS. 3-8], and/or the vertical axis 86 [FIGS. 3-8]) to another overlapping portion different from the overlapping portion 80 where the coaster 40 received the ride vehicle 20 from the vehicle ride path 12. In this manner, a portion of the vehicle ride path 12 may be avoided (e.g., for maintenance purposes, for experience enhancing purposes, for theming purposes, and so forth). In other words, use and operation of the ride vehicle 20 to entertain passengers 22 may continue without utilizing the portion of the vehicle ride path 12.

After being transported to another overlapping portion, the control system 50 may disengage the vehicle securing mechanism 36 and/or the coaster securing mechanism 48 to release the ride vehicle 20 from the coaster 40. The control system 50 may also send a signal to the vehicle securing mechanism 36 to cause the vehicle securing mechanism 36 to couple and to secure the ride vehicle 20 to the vehicle ride path 12. That is, the control system 50 may cause the securing mechanism(s) to re-engage (process block 212), as described above, to secure the ride vehicle 20 to the vehicle ride path 12 to enable motion of the ride vehicle 20 along the vehicle ride path 12.

While only certain features of the disclosed embodiments have been illustrated and described herein, many modifications and changes will occur to those skilled in the art. It is, therefore, to be understood that the appended claims are intended to cover all such modifications and changes as fall within the true spirit of the disclosure.

Technical effects of the present disclosure include a ride system that includes a ride vehicle configured to travel along a vehicle ride path and includes a coaster configured to travel along a coaster ride path. The coaster ride path may be defined by a first end and a second end, where the first end intersects the vehicle ride path at a first overlapping portion, and the second end intersects the vehicle ride path at a second overlapping portion. In this manner, the coaster may travel between the first and second portions of the vehicle ride path to transport the ride vehicle between the first and second portions of the vehicle ride path along the coaster ride path instead of along the vehicle ride path. In this manner, the coaster may transport the ride vehicle between floors, between separate ride paths, and/or between portions of a single ride path. As a result, the section of the vehicle ride path between the first and second portions of the vehicle ride path may be avoided during certain runs of the ride system, for example, to facilitate maintenance of that section between the first and second portions of the vehicle ride path or for experience-enhancing purposes.

This written description uses examples of the presently disclosed embodiments, including the best mode, and also to enable any person skilled in the art to practice the disclosed embodiments, including making and using any devices or systems and performing any incorporated methods. The patentable scope of the disclosed embodiments is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A ride system, comprising:

a vehicle configured to travel along a first ride path defined by a first track; and a coaster configured to travel along a second ride path defined by a second track, wherein the first track and the second track cross one another at an overlapping portion of the ride system, wherein the vehicle is configured to disengage from a first portion of the first track and engage with the coaster when the coaster and the vehicle are positioned at the overlapping portion, wherein the coaster is configured to transport the vehicle along the second ride path to a second portion of the first ride path after engaging with the vehicle.

2. The ride system of claim 1, wherein the first ride path comprises a ride path section extending from the first portion of the first ride path to the second portion of the first ride path, wherein the ride path section is separate from the second ride path.

3. The ride system of claim 1, comprising a vehicle securing mechanism of the vehicle, wherein the vehicle securing mechanism is configured to confine motion of the vehicle to the first ride path in an engaged configuration of the vehicle securing mechanism.

4. The ride system of claim 3, wherein the vehicle securing mechanism is configured to permit the vehicle to disengage from the first ride path in a disengaged configuration.

5. The ride system of claim 1, wherein the coaster is positioned under a surface comprising the first track except when the coaster and the vehicle are positioned at the overlapping portion of the ride system.

6. The ride system of claim 1, wherein the coaster comprises a coaster securing mechanism configured to selectively secure the vehicle to the coaster.

7. The ride system of claim 1, wherein the coaster comprises a coaster securing mechanism, and the vehicle comprises a vehicle securing mechanism, wherein the coaster securing mechanism and the vehicle securing mechanism are configured to engage with one another in a male and female securing configuration in an engaged configuration.

8. The ride system of claim 1, wherein the first portion of the first ride path and the second portion of the first ride path are positioned at different vertical locations of the ride system, and wherein the coaster is configured to vertically transport the vehicle along the second ride path from the first portion to the second portion.

9. The ride system of claim 8, wherein the second ride path comprises a segment oriented along a gravity vector.

10. The ride system of claim 1, wherein the second ride path extends beneath the first portion of the first ride path at the overlapping portion, such that a top of the coaster is configured to directly couple with a chassis of the vehicle at the overlapping portion.

11. The ride system of claim 1, wherein the first track is oriented along and defines a direction of travel for the vehicle, wherein the first track is configured to rotate to transport the vehicle to the coaster.

12. A method for controlling multi-dimensional motion of a vehicle, comprising:

instructing, via a controller, the vehicle traveling along a first ride path defined by a first track to stop the vehicle at a first position along the first ride path;

instructing, via the controller, a coaster traveling along a second ride path defined by a second track to stop at a second position along the second ride path, wherein the first position and the second position overlap with one another;

controlling actuation, via the controller, of one or more securing mechanisms to release the vehicle from the first track at the first position and to secure the vehicle to the coaster; and instructing, via the controller, the coaster to travel along the second ride path defined by the second track to a third position along the second ride path and to stop at the third position, wherein the third position overlaps with the first ride path.

13. The method of claim 12, comprising controlling actuation, via the controller, of the one or more securing mechanisms to release the vehicle from the coaster and to engage the vehicle with the first track when the coaster is at the third position.

14. The method of claim 12, wherein actuating the one or more securing mechanisms to release the vehicle from the first track at the first position and to secure the vehicle to the coaster comprises:

controlling actuation, via the controller, of a coaster securing mechanism to secure the vehicle to the coaster; and controlling actuation, via the controller, of a vehicle securing mechanism to release the vehicle from the first track at the first position.

15. The method of claim 12, wherein the third position overlaps with a fourth position along the first ride path, and wherein instructing, via the controller, the coaster to travel along the second ride path defined by the second track to the third position along the second ride path comprises bypassing, with the vehicle, a section of the first ride path defined by the first track extending between the first position and the fourth position.

16. The method of claim 12, further comprising:

tracking, via the controller, multi-dimensional motion of the vehicle along the first ride path to collect feedback indicative of a position, a velocity, an acceleration, or any combination thereof, of the vehicle; and instructing, via the controller, the coaster traveling along the second ride path defined by the second track to stop at the second position along the second ride path based on the feedback.

17. A ride system, comprising:

a first ride path defined by a first track and configured to guide a ride vehicle along the first ride path;

a second ride path defined by a second track and configured to guide a coaster along the second ride path, wherein the first ride path and the second ride path overlap with one another at a plurality of overlapping portions; and a controller comprising a processor and a memory device having instructions stored thereon, wherein the instructions are configured to be executed by the processor, and wherein the instructions are configured to cause the processor to:

output a first signal to stop the ride vehicle at a first position along the first ride path, wherein the first position is at a first overlapping portion of the plurality of overlapping portions;

output a second signal to stop the coaster at a second position along the second ride path, wherein the second position is at the first overlapping portion of the plurality of overlapping portions;

output a third signal to actuate one or more securing mechanisms to release the ride vehicle from the first track at the first overlapping portion and to secure the ride vehicle to the coaster; and output a fourth signal to actuate the coaster to travel along the second ride path via the second track to a second overlapping portion of the plurality of overlapping portions.

18. The ride system of claim 17, wherein the instructions are configured to cause the processor to instruct the one or more securing mechanisms to release the ride vehicle from the coaster and to secure the ride vehicle to the first track at the second overlapping portion of the plurality of overlapping portions.

19. The ride system of claim 17, wherein the instructions are configured to output a fifth signal to accelerate the ride vehicle along the first ride path in response to a verification that the one or more securing mechanisms released the ride vehicle from the coaster and secured the ride vehicle to the first track at the second overlapping portion.

20. The ride system of claim 17, wherein the first ride path defined by the first track comprises a first segment extending between the first overlapping portion of the plurality of overlapping portions and the second overlapping portion of the plurality of overlapping portions, and wherein the second ride path defined by the second track comprises a second segment extending between the first overlapping portion of the plurality of overlapping portions and the second overlapping portion of the plurality of overlapping portions.

* * * * *